US008052812B2

(12) United States Patent
Kariya et al.

(10) Patent No.: US 8,052,812 B2
(45) **Date of Patent: *Nov. 8, 2011**

(54) METHOD OF MANUFACTURING HIGH CARBON COLD-ROLLED STEEL SHEET

(75) Inventors: Nobusuke Kariya, Kanagawa (JP); Norio Kanamoto, Chiba (JP); Hidekazu Ookubo, Chiba (JP); Yoshiharu Kusumoto, Chiba (JP); Takeshi Fujita, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 66 days.

This patent is subject to a terminal disclaimer.

(21) Appl. No.: 11/922,158

(22) PCT Filed: Jun. 19, 2006

(86) PCT No.: PCT/JP2006/312669

§ 371 (c)(1),
(2), (4) Date: Oct. 29, 2008

(87) PCT Pub. No.: WO2007/000954

PCT Pub. Date: Jan. 4, 2007

(65) Prior Publication Data

US 2009/0095382 A1 Apr. 16, 2009

(30) Foreign Application Priority Data

Jun. 29, 2005 (JP) ..... 2005-189577

(51) Int. Cl.
*C21D 8/02* (2006.01)
*C22C 38/00* (2006.01)

(52) U.S. Cl. ..... 148/603; 148/330; 148/333; 148/336; 148/337

(58) Field of Classification Search ..... 148/603, 148/337, 330, 333, 336
See application file for complete search history.

(56) References Cited

U.S. PATENT DOCUMENTS

2004/0055673 A1* 3/2004 Kimura et al. ..... 148/610
2005/0199322 A1 9/2005 Nakamura et al.
(Continued)

FOREIGN PATENT DOCUMENTS

JP 03-174909 A 7/1991
(Continued)

OTHER PUBLICATIONS

Machine translation of JP 2003-013144.*
(Continued)

*Primary Examiner* — Emily Le
*Assistant Examiner* — Rebecca Lee
(74) *Attorney, Agent, or Firm* — RatnerPrestia

(57) ABSTRACT

A high carbon cold-rolled steel sheet having both excellent stretch-flange formability and excellent homogeneity of hardness in the sheet thickness direction is provided by a manufacturing method having the steps of: hot-rolling a steel containing 0.2 to 0.7% C by mass at finishing temperatures of ($A_{r3}$ transformation point −20° C.) or above to prepare a hot-rolled sheet; cooling the hot-rolled sheet to temperatures of 650° C. or below at cooling rates from 60° C./s or larger to smaller than 120° C./s; coiling the hot-rolled sheet after cooling at coiling temperatures of 600° C. or below; cold-rolling the coiled hot-rolled sheet at rolling reductions of 30% or more to prepare a cold-rolled sheet; and annealing the cold-rolled sheet at annealing temperatures from 600° C. or larger to $A_{c1}$ transformation point or lower.

6 Claims, 1 Drawing Sheet

U.S. PATENT DOCUMENTS

2009/0126836 A1 5/2009 Kariya et al.

FOREIGN PATENT DOCUMENTS

| | | | | |
|---|---|---|---|---|
| JP | 05-009588 | A | | 1/1993 |
| JP | 05-195056 | A | | 8/1993 |
| JP | 05-255799 | A | | 10/1993 |
| JP | 06-271935 | A | | 9/1994 |
| JP | 09-157758 | A | | 6/1997 |
| JP | 11279637 | A | * | 10/1999 |
| JP | 2003-013144 | A | | 1/2003 |
| JP | 2003-013145 | A | | 1/2003 |
| JP | 2003-073740 | A | | 3/2003 |
| JP | 2003-073742 | A | | 3/2003 |
| JP | 2003-089846 | A | | 3/2003 |
| JP | 2004-137554 | A | | 5/2004 |
| JP | 2005-097740 | A | | 4/2005 |
| JP | 2006-063394 | A | | 3/2006 |
| JP | 2006-097109 | A | | 4/2006 |

OTHER PUBLICATIONS

U.S. Appl. No. 11/922,250, Confirmation No. 5950.

English-language machine translation of JP 2003-013145.

P. Spiekermann, "Legierungen—Ein Besonders Patentrecht Liches Problem . . . ", *Mitteilungen Der Deutschen Patentawaelte*, pp. 178-190 (1993) together with S. Spiekermann, "Alloys—a special problem of patent law" Nonpublished English Translation of Document, pp. 1-20.

* cited by examiner

METHOD OF MANUFACTURING HIGH CARBON COLD-ROLLED STEEL SHEET

This application is the United States national phase application of International Application PCT/JP2006/312669 filed Jun. 19, 2006.

TECHNICAL FIELD

The present invention relates to a method for manufacturing high carbon cold-rolled steel sheet containing 0.2 to 0.7% C by mass and having excellent workability.

BACKGROUND ART

Users of high carbon steel sheets as tools, automotive parts (gear and transmission), and the like request excellent workability because these steel sheets are formed in various complex shapes. In recent years, on the other hand, requirement of reduction in the cost for manufacturing parts increases. Responding to the requirement, some working processes are eliminated and working methods are changed. For example, as the forming technology of automobile driving system parts using high carbon steel sheets, there was developed a double-acting forming technique which allows applying thickness-additive forming process and realizes significant shortening of manufacturing process, and the technique has been brought into practical applications in a part of industries, (for example, refer to Journal of the JSTP, 44, pp. 409-413, (2003)).

Along with that movement, the high carbon steel sheets face ever-increasing request of workability to attain higher ductility than ever. Since some of the parts are often subjected to hole-expansion (burring) treatment after punching, they are wanted to have excellent stretch-flange formability.

Furthermore, from the viewpoint of cost reduction accompanied with increase in the product yield, these steel sheets are strongly requested to have homogeneous mechanical properties. In particular, the homogeneity of hardness in the sheet thickness direction is keenly desired because large differences of hardness in the steel sheet thickness direction between the surface portion and the central portion significantly deteriorate the punching tool during punching.

To answer these requests, several technologies were studied to improve the workability and homogeneous mechanical properties of high carbon steel sheets.

For example, JP-A-9-157758, (the term "JP-A" referred to herein signifies the "Unexamined Japanese Patent Publication")), proposed a method for manufacturing high carbon cold-rolled workable steel strip having improved workability by the steps of:

- hot-rolling a high carbon steel having a specified chemical composition, followed by descaling therefrom;
- annealing the steel in a hydrogen atmosphere (95% or more of hydrogen by volume) while specifying heating rate, soaking temperature ($A_{c1}$ transformation point or above), and soaking time depending on the chemical composition;
- cooling the annealed steel at cooling rates of 100° C./hr or smaller to prepare a hot-rolled workable steel strip having excellent structural homogeneity and workability (ductility);
- cold-rolling the steel strip at rolling reductions from 20 to 90%; and
- finish-annealing the steel at temperatures from 600° C. to 720° C. in a nitrogen-atmosphere furnace or the like.

Furthermore, for example, JP-A-5-9588 proposed a method for manufacturing high carbon cold-rolled steel thin sheet having good workability by the steps of:

- rolling a steel at finishing temperatures of ($A_{c1}$ transformation point +30° C.) or above to prepare a steel sheet;
- cooling the steel sheet to temperatures from 20° C. to 500° C. at cooling rates from 10 to 100° C./s;
- holding the steel sheet for 1 to 10 seconds;
- reheating the steel sheet to temperatures from 500° C. to ($A_{c1}$ transformation point +30° C.), followed by coiling the steel sheet;
- soaking the steel sheet, at need, at temperatures from 650° C. to ($A_{c1}$ transformation point +30° C.) for 1 hour or more; and
- applying a cycle of cold-rolling and annealing at temperatures from 650° C. to ($A_{c1}$ transformation point +30° C.) for 1 hour or more, at least once.

Other than above, as the hot-rolled steel sheets, JP-A-3-174909, for example, proposed a method for manufacturing stably a high carbon hot-rolled steel strip having excellent homogeneous mechanical properties in the longitudinal direction of coil by the steps of:

- dividing a hot-run table (or run-out table) into an accelerated cooling zone and an air-cooling zone;
- applying accelerated cooling to a finish-rolled steel strip to a specific temperature or below determined by the length of cooling zone, the transfer speed of steel sheet, the chemical composition of the steel, and the like; and then
- applying air-cooling to the steel strip.

The cooling rate in the accelerated cooling zone according to JP-A-3-174909 is about 20 to about 30° C./s suggested by FIG. 3 in the disclosure.

In addition, for example, JP-A-2003-13145 proposed a method for manufacturing high carbon hot-rolled steel sheet having excellent stretch-flanging formability by the steps of:

- using a steel containing 0.2 to 0.7% C by mass;
- hot-rolling the steel at finishing temperatures of ($A_{r3}$ transformation point −20° C.) or above;
- cooling the steel sheet at cooling rates of higher than 120° C./s and at cooling-stop temperatures of not higher than 650° C.;
- coiling the steel sheet at temperatures of 600° C. or below; and then
- annealing the steel sheet at temperatures from 640° C. or larger to $A_{c1}$ transformation point or lower.

Although the object does not agree with that of above examples, JP-A-2003-73742 disclosed a technology for manufacturing high carbon hot-rolled steel sheet which satisfies the above requirements except for selecting the cooling-stop temperature of 620° C. or below. In addition, JP-A-2003-73740 disclosed a technology for manufacturing high carbon cold-rolled steel sheet which satisfies the above requirements except for selecting the cooling-stop temperatures of 620° C. or below and applying the annealing after cold-rolling at rolling reductions of 30% or more.

DISCLOSURE OF THE INVENTION

Problems to be Solved by the Invention

The related art, however, cannot assure the homogeneous mechanical properties including that homogeneity in the sheet thickness direction, and specifically fails to assure the homogeneous mechanical properties including that homogeneity in the sheet thickness direction at the stage of hot-rolled sheet, thus the related art has an issue of improving the cold-rolling performance. Furthermore, the related art cannot attain both that homogeneity and the stretch-flange formability.

The above related art also has the problems described below.

The methods disclosed in JP-A-3-174909, JP-A-2003-13145, and JP-A-2003-73742 manufacture a hot-rolled steel sheet, and are difficult to manufacture a thin steel sheet homogeneously at high accuracy. In addition, since these methods have substantially no recrystallization step, there is an issue of improvement in the homogeneous mechanical properties.

For the case of JP-A-3-174909, the obtained steel sheet is what is called the "as hot-rolled" steel sheet without subjected to heat treatment after hot-rolling. Accordingly, the manufactured steel sheet not necessarily attains excellent elongation and stretch-flange formability.

Regarding the method disclosed in JP-A-9-157758, a microstructure composed of pro-eutectoid ferrite and pearlite containing lamellar carbide is formed depending on the hot-rolling condition, and the succeeding annealing converts the lamellar carbide into fine spheroidal cementite. Thus formed fine spheroidal cementite becomes the origin of voids during hole-expansion step, and the generated voids connect with each other to induce fracture of the steel. As a result, no excellent stretch-flange formability is attained.

According to the method disclosed in JP-A-5-9588, the steel sheet after hot-rolling is cooled under a specified condition, followed by reheating thereof by direct electric heating process and the like. As a result, a special apparatus is required and a vast amount of electric energy is consumed. In addition, since the steel sheet coiled after reheating likely forms fine spheroidal cementite, there are often failed to obtain excellent stretch-flange formability owing to the same reason to that given above.

An object of the present invention is to provide a method for manufacturing high carbon cold-rolled steel sheet which has excellent stretch-flange formability and excellent homogeneity of hardness in the sheet thickness direction, and gives easier cold-rolling step.

Means to Solve the Problems

The inventors of the present invention conducted detail study of the effect of microstructure on the stretch-flange formability and the hardness of high carbon cold-rolled steel sheet, and found that it is extremely important to adequately control the manufacturing conditions, specifically the cooling condition after hot-rolling, the coiling temperature, and the annealing temperature after cold-rolling, thus found that the stretch-flange formability is improved and the hardness in the sheet thickness direction becomes homogeneous by controlling the volume percentage of carbide having smaller than 0.5 μm of particle size (volume percentage thereof to the total carbide in the steel sheet), determined by the method described later, to 10% or less.

Furthermore, the inventors of the present invention found that further excellent stretch-flange formability and homogeneous distribution of hardness are attained by controlling more strictly the cooling condition after hot-rolling and the coiling temperature, thereby controlling the volume percentage of the carbide to 5% or less.

The present invention has been perfected on the basis of above findings, and the present invention provides a method for manufacturing high carbon cold-rolled steel sheet having excellent workability, by the steps of: hot-rolling a steel containing 0.2 to 0.7% C by mass at finishing temperatures of ($A_{r3}$ transformation point −20° C.) or above to prepare a hot-rolled sheet; cooling thus hot-rolled sheet to temperatures of 650° C. or below, (called the "cooling-stop temperature"), at cooling rates from 60° C./s or larger to smaller than 120° C./s; coiling the hot-rolled sheet after cooling at coiling temperatures of 600° C. or below; cold-rolling the coiled hot-rolled sheet at rolling reductions of 30% or more to prepare a cold-rolled sheet; and annealing the cold-rolled sheet at annealing temperatures from 600° C. or larger to $A_{c1}$ transformation point or lower.

According to the method of the present invention, it is more preferable that, for the above manufacturing method, the cooling step and the coiling step are conducted by cooling the hot-rolled sheet to temperatures of 600° C. or below at cooling rates from 80° C./s or larger to smaller than 120° C./s, and then coiling the sheet at temperatures of 550° C. or below.

In the above manufacturing method, it is also possible that the hot-rolled sheet after coiling is annealed at annealing temperatures from 600° C. or larger to $A_{c1}$ transformation point or lower, (called the "annealing of hot-rolled sheet"), followed by cold-rolling.

Generally the coiled hot-rolled sheet is subjected to descaling such as pickling before cold-rolling.

BEST MODE FOR CARRYING OUT THE INVENTION

Figure 1:
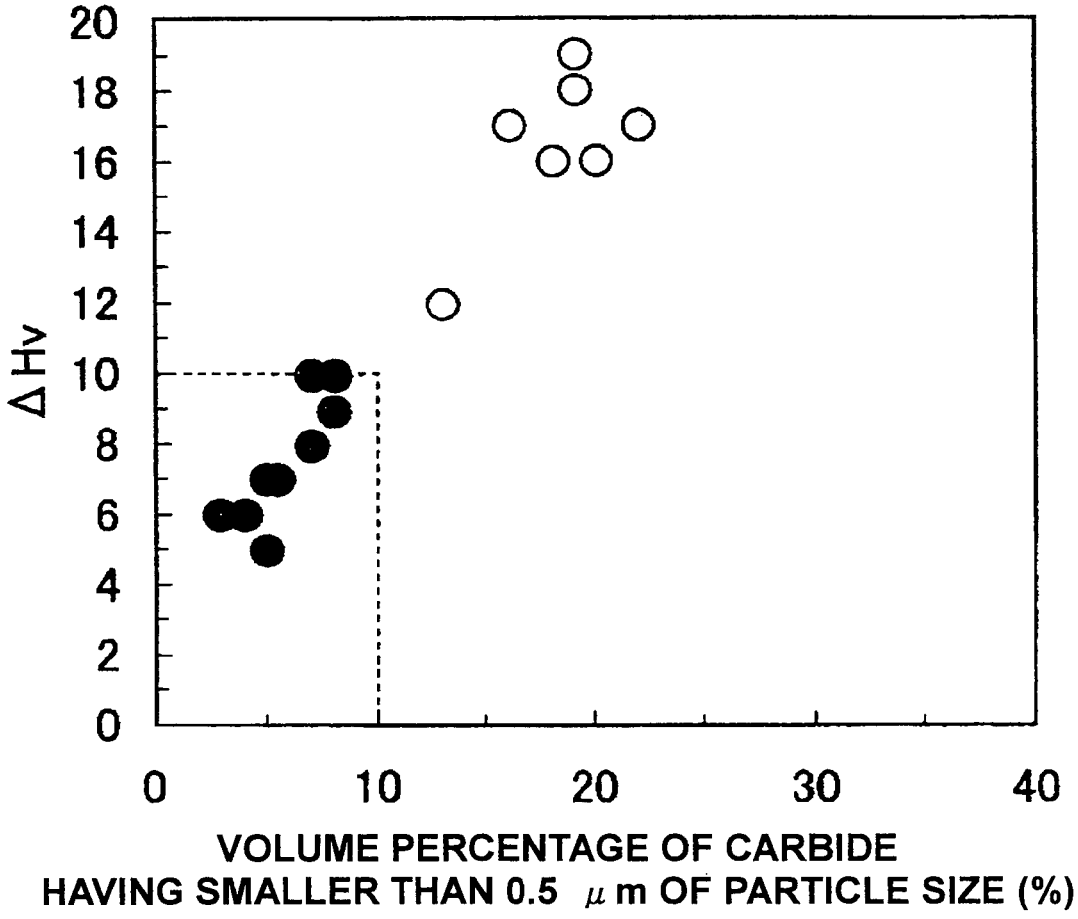
FIG. 1 shows the relation between ΔHv (vertical axis) and volume percentage (horizontal axis) of carbide having smaller than 0.5 μm of particle size, in annealed cold-rolled sheets.

The method for manufacturing the high carbon cold-rolled steel sheet according to the present invention is described below in detail.

<Steel Composition>

(1) C Content

Carbon is an important element of forming carbide and providing hardness after quenching. If the C content is less than 0.2% by mass, formation of pre-eutectoid ferrite after hot-rolling becomes significant, and the volume percentage of carbide having smaller than 0.5 μm of particle size increases after cold-rolling and annealing, thereby deteriorating the stretch-flange formability and the homogeneity of hardness in the sheet thickness direction. In addition, even after quenching, satisfactory strength as the machine structural parts cannot be attained. On the other hand, if the C content exceeds 0.7% by mass, sufficient stretch-flange formability cannot be attained even if the volume percentage of carbide having smaller than 0.5 μm of particle size is 10% or less. In addition, the hardness after hot-rolling significantly increases to result in inconvenience in handling owing to the brittleness of the steel sheet, and also the strength as the machine structural parts after quenching saturates. Therefore, the C content is specified to a range from 0.2 to 0.7% by mass.

For the case that the hardness after quenching is emphasized, it is preferable to specify the C content to above 0.5% by mass. For the case that the workability is emphasized, it is preferable to specify the C content to 0.5% or less by mass.

(2) Other Steel Compositions

Although there is no specific limitation on the elements other than C, elements such as Mn, Si, P, S, Sol.Al, and N can be added within ordinary respective ranges. Since, however, Si likely converts carbide into graphite, thus interfering the hardenability by quenching, the Si content is preferably specified to 2% or less by mass. Since excess amount of Mn likely induces the decrease in ductility, the Mn content is preferably specified to 2% or less by mass. Since excess amount of P and S decreases ductility and likely induces cracks, the content of P and S is preferably specified to 0.03% or less by mass, respectively. Since excess amount of Sol.Al deteriorates the hardenability by quenching owing to the precipitation of AlN in a large amount, and since excess amount of N deteriorates ductility, the Sol.Al content is preferably specified to 0.08% or less by mass, and the N content is preferably specified to 0.01% or less by mass. For improving significantly the stretch-flange formability, the S content is preferably specified to 0.007% or less by mass, and for further significant improvement thereof, the S content is preferably specified to 0.0045% or less by mass.

Depending on the objectives of improvement in hardenability by quenching and/or improvement in resistance to temper softening, the effect of the present invention is not affected by the addition of elements such as B, Cr, Cu, Ni, Mo, Ti, Nb, W, V, and Zr within ordinarily adding ranges to the high carbon cold-rolled steel sheet. Specifically for these elements, there can be added: B in amounts of about 0.005% or less by mass, Cr about 3.5% or less by mass, Ni about 3.5% or less by mass, Mo about 0.7% or less by mass, Cu about 0.1% or less by mass, Ti about 0.1% or less by mass, Nb about 0.1% or less by mass, and W, V, and Zr, as the total, about 0.1% or less by mass. On adding Cr and/or Mo, it is preferable to add Cr in amounts of about 0.05% or more by mass and Mo about 0.05% or more by mass.

Furthermore, even if elements such as Sn and Pb entered the steel composition as impurities during the manufacturing process, they do not affect the effect of the present invention.

<Hot-Rolling Conditions>

(3) Finishing Temperature of Hot-Rolling

If the finishing temperature is below ($A_{r3}$ transformation point −20° C.), the ferrite transformation proceeds in a part, which increases the volume percentage of carbide having smaller than 0.5 μm of particle size, thereby deteriorating both the stretch-flange formability and the homogeneity of hardness in the sheet thickness direction. Accordingly, the finishing temperature of hot-rolling is specified to ($A_{r3}$ transformation point −20° C.) or above. The $A_{r3}$ transformation point may be the actually determined value, and may be the calculated value of the following formula (1).

$$A_{r3}\text{ transformation point}=910-203[C]^{1/2}+44.7[Si]-30[Mn] \quad (1)$$

where, [M] designates the content (% by mass) of the element M.

Responding to the additional elements, correction terms such as (−11[Cr]), (+31.5[Mo]), and (−15.2[Ni]) may be added to the right-hand member of the formula (1).

(4) Condition of Cooling after Hot-Rolling

If the cooling rate after hot-rolling is smaller than 60° C./s, the supercooling of austenite becomes small, and the formation of pre-eutectoid ferrite after hot-rolling becomes significant. As a result, the volume percentage of carbide having smaller than 0.5 μm of particle size exceeds 10% after cold-rolling and annealing, thereby deteriorating both the stretch-flange formability and the homogeneity of hardness in the sheet thickness direction.

If the cooling rate exceeds 120° C./s, the temperature difference in the sheet thickness direction, between the surface portion and the central portion, increases, and the formation of pre-eutectoid ferrite becomes significant at the central portion. As a result, both the stretch-flange formability and the homogeneity of hardness in the sheet thickness direction deteriorate, similar to above. The tendency becomes specifically large when the sheet thickness of hot-rolled sheets becomes 4.0 mm or larger.

That is, to specifically homogenize the hardness in the sheet thickness direction, there exists an adequate cooling rate, and excessively large or excessively small cooling rates cannot attain the desired homogeneity of hardness. In related art, particularly the optimization of cooling rate is not attained so that the homogeneity of hardness cannot be assured.

Consequently, the cooling rate after hot-rolling is specified to a range from 60° C./s or larger to smaller than 120° C./s. Furthermore, if the volume percentage of carbide having smaller than 0.5 μm of particle size is to be brought to 5% or less, the cooling rate is specified to a range from 80° C./s or larger to smaller than 120° C./s. It is more preferable to specify the upper limit of the cooling rate to 115° C./s or smaller.

If the end point of the cooling of hot-rolled sheet with that cooling rates, or the cooling-stop temperature, is higher than 650° C., the pre-eutectoid ferrite is formed, and the pearlite containing lamella carbide is formed during the cooling step before coiling the hot-rolled sheet. As a result, the volume percentage of carbide having smaller than 0.5 μm of particle size exceeds 10% after cold-rolling and annealing, thereby deteriorating the stretch-flange formability and the homogeneity of hardness in the sheet thickness direction. Therefore, the cooling-stop temperature is specified to 650° C. or below, and more preferably to 600° C. or below.

To bring the volume percentage of the carbide having smaller than 0.5 μm of particle size to 5% or less, there are specified, as described above, the cooling rate in a range from 80° C./s or larger to 120° C./s or smaller, (preferably 115° C./s or smaller), and the cooling-stop temperature of 600° C. or below.

Since there is a problem of accuracy of temperature measurement, the cooling-stop temperature is preferably specified to 500° C. or above.

After reaching the cooling-stop temperature, natural cooling may be applied, or forced cooling may be continued with a weakened cooling force. From the viewpoint of homogeneous mechanical properties of the steel sheet, however, forced cooling to a degree of suppressing the reheating is preferred.

(5) Coiling Temperature

The hot-rolled sheet after cooling is coiled. If the coiling temperature exceeds 600° C., pearlite containing lamella carbide is formed. As a result, the volume percentage of carbide having smaller than 0.5 μm of particle size exceeds 10% after cold-rolling and annealing, thereby deteriorating the stretch-flange formability and the homogeneity of hardness in the sheet thickness direction. Therefore, the coiling temperature is specified to 600° C. or below. The coiling temperature is selected to a temperature below the above cooling-stop temperature.

For bringing the volume percentage of carbide having smaller than 0.5 μm of particle size to 5% or less, there are specified, as above, the cooling rate to a range from 80° C./s or larger to 120° C./s or smaller, (preferably 115° C./s or smaller), the cooling-stop temperature to 600° C. or below, and the coiling temperature to 550° C. or below.

To prevent the deterioration of shape of the hot-rolled sheet, the coiling temperature is preferably specified to 200° C. or above, and more preferably to 350° C. or above.

(6) Descaling (Pickling and the Like)

The hot-rolled sheet after coiling is generally subjected to descaling before applying cold-rolling. Although there is no specific limitation on the scale-removal method, it is preferably to adopt ordinary pickling.

When annealing of hot-rolled sheet, (described below), is applied, the descaling is given before the annealing of hot-rolled sheet.

<Cold-Rolling and Annealing Conditions>

(7) Cold-Rolling

The hot-rolled sheet after pickling is subjected to cold-rolling so as the non-crystallized portion not to be left behind after annealing and so as the spheroidization of carbide to be enhanced. To attain those effects, the rolling reduction in the cold-rolling is specified to 30% or more.

The hot-rolled sheet obtained from the above-described steel compositions and under the above-described hot-rolling conditions according to the present invention has excellent homogeneity of hardness in the sheet thickness direction, thus the sheet less likely raises troubles such as fracture even in the working under higher rolling reduction than that of related art. If, however, the load to rolling mill is taken into account, the rolling reduction is preferably specified to 80% or less.

(8) Annealing Temperature

The cold-rolled sheet is treated by annealing to conduct recrystallization and spheroidization of carbide. If the annealing temperature is below 600° C., non-crystallized structure is left behind, and the stretch-flange formability and the homogeneity of hardness in the sheet thickness direction deteriorate. If the annealing temperature exceeds the $A_{c1}$ transformation point, the austenite formation proceeds in a part, and the pearlite again forms during cooling, which deteriorates the stretch-flange formability and the homogeneity of hardness in the sheet thickness direction. Accordingly, the annealing temperature is specified to a range from 600° C. to ($A_{c1}$ transformation point). To attain excellent stretch-flange formability, the annealing temperature is preferably specified to 680° C. or above.

The $A_{c1}$ transformation point may be the actually determined value, and may be the calculated value of the following formula (2).

$$A_{c1}\text{ transformation point}=754.83-32.25[C]+23.32[Si]-17.76[Mn] \quad (2)$$

where, [M] designates the content (% by mass) of the element M.

Responding to the additional elements, correction terms such as (+17.13[Cr]), (+4.51[Mo]), and (+15.62[V]) may be added to the right-hand member of the formula (2).

The annealing time is preferably between about 8 hours and about 80 hours. The carbide in thus obtained steel sheet is spheroidized, giving 3.0 or smaller average aspect ratio, (determined at a depth of about one fourth in the sheet thickness direction).

<Condition of Annealing of Hot-Rolled Sheet> (Arbitrary)

The object of the present invention is achieved under the above-described conditions. The hot-rolled sheet after pickling and before cold-rolling can be treated by annealing to make the carbide spheroidize, (the annealing is called the "annealing of hot-rolled sheet"). For the annealing of hot-rolled sheet, however, the effect cannot be attained below 600° C. of the temperature of annealing of hot-rolled sheet. If the temperature of annealing of hot-rolled sheet exceeds the $A_{c1}$ transformation point, austenitization proceeds in a part, thereby failing to attain the spheroidizing effect because of the formation of pearlite again during the cooling step. To obtain excellent stretch-flange formability, the temperature of annealing of hot-rolled sheet is preferably specified to 680° C. or above, and more preferably to 690° C. or above.

The time of annealing of hot-rolled sheet is preferably in a range from about 8 hours to about 80 hours.

The annealing of hot-rolled sheet is preferred from the point of improvement in the homogeneity and of reducing the load to cold-rolling. However, if there is no problem on the target homogeneity, on the sheet thickness, and on the capacity of cold-rolling apparatus, the annealing of hot-rolled sheet can be eliminated to decrease the cost.

<Other>

For steel making of the high carbon steel according to the present invention, either converter or electric furnace can be applied. Thus made high carbon steel is formed into slab by ingoting and blooming or by continuous casting.

The slab is normally heated, (reheated), and then treated by hot-rolling. For the slab manufactured by continuous casting may be treated by hot direct rolling directly from the slab or after heat-holding to prevent temperature reduction. For the case of hot-rolling the slab after reheating, the slab heating temperature is preferably specified to 1280° C. or below to avoid the deterioration of surface condition caused by scale.

The hot-rolling can be given only by finish rolling eliminating rough rolling. To assure the finishing temperature, the material being rolled may be heated during hot-rolling using a heating means such as sheet bar heater. To enhance spheroidization or to decrease hardness, the coiled sheet may be thermally insulated by a slow-cooling cover or other means.

Although the thickness of the hot-rolled sheet is not specifically limited if only the manufacturing conditions of the present invention are maintained, a particularly preferable range of the thickness thereof is from 1.0 to 10.0 mm from the point of operability. Although there is no specific limitation of the thickness of cold-rolled steel sheet, a preferable range thereof is from about 0.5 to about 5.0 mm.

The annealing of hot-rolled sheet and the annealing after cold-rolling can be done either by box annealing or by continuous annealing. After cold-rolling and annealing, skin-pass rolling is applied, at need. Since the skin-pass rolling does not affect the hardenability by quenching, there is no specific limitation of the condition of skin-pass rolling.

Regarding the amount of carbide having 0.5 μm or coarse particle size in the steel sheet, there raises no problem if only the amount is within that corresponding to the C content according to the present invention.

EXAMPLES

Example 1

Continuously cast slabs of Steels A to D having the respective chemical compositions shown in Table 1 were heated to 1250° C. Thus heated slabs were treated by hot-rolling, cold-rolling, and annealing under the respective conditions given in Table 2 to form the Steel sheets Nos. 1 to 16, having a sheet thickness of 2.3 mm. For some conditions, the annealing of hot-rolled sheet was applied under the respective conditions given in Table 2. Each annealing treatment was given in a non-nitrizing atmosphere, (Ar atmosphere).

Steel sheets Nos. 1 to 9 are Examples of the present invention, and Steel sheets Nos. 10 to 16 are Comparative Examples. The following methods were adopted to determine the particle size and volume percentage of carbide, the hardness in the sheet thickness direction, and the hole-expansion rate λ. The hole-expansion rate λ was adopted as an index to evaluate the stretch-flange formability. The hardness in the sheet thickness direction was determined also on the hot-rolled sheets after coiling, (after annealing of hot-rolled sheet for the material being treated by the annealing of hot-rolled sheet).

(i) Determination of Particle Size and Volume Percentage of Carbide

A cross section of steel sheet parallel to the rolling direction was polished, which section was then etched at a depth of one fourth of sheet thickness using a Picral solution (picric acid+ethanol). The microstructure on the etched surface was observed by a scanning electron microscope (×3000 magnification).

The particle size and volume percentage of carbide were quantitatively determined by image analysis using the image analyzing software "Image Pro Plus ver. 4.0™" manufactured by Media Cybernetics, Inc. That is, the particle size of each carbide was determined by measuring the diameter between two point on outer peripheral circle of the carbide and passing through the center of gravity of an equivalent ellipse of the carbide, (an ellipse having the same area to that of carbide and having the same first moment and second moment to those of the carbide), at intervals of 2 degrees, and then averaging thus measured diameters.

Furthermore, for all the carbides within the visual field, the area percentage of every carbide to the measuring visual field was determined, which determined value was adopted as the volume percentage of the carbide. For the carbides having smaller than 0.5 μm of particle size, the sum of volume percentages, (cumulative volume percentage), was determined, which was then divided by the cumulative volume percentage of all carbides, thus obtained the volume percentage for every visual field. The volume percentage was determined on 50 visual fields, and those determined volume percentages were averaged to obtain the volume percentage of carbide having smaller than 0.5 μm of particle size.

In the above image analysis, the average aspect ratio (number average) of carbide was also calculated, and the spheroidization was confirmed.

(ii) Hardness Determination in the Sheet Thickness Direction

The cross section of steel sheet parallel to the rolling direction was polished. The hardness was determined using a micro-Vickers hardness tester applying 4.9 N (500 gf) of load at nine positions: 0.1 mm depth from the surface of the steel sheet; depths of ⅛, ⅜, ⅜, ⅜, ⅝, ⅝, and ⅞ of the sheet thickness; and 0.1 mm depth from the rear surface thereof.

The homogeneity of hardness in the sheet thickness direction was evaluated by the difference between maximum hardness Hv max and the minimum hardness $H_{V\ min}$, ΔHv ($=H_{V\ max}-H_{V\ min}$). When ΔHv≦10, the homogeneity of hardness was evaluated as excellent.

On determining ΔHv, when the sheet thickness is small and when the point of ⅛ and ⅞ of the sheet thickness are within 0.1 mm from the surface and the rear surface of the steel sheet, respectively, the hardness determination at the point of 0.1 mm from the surface and the rear surface of the steel sheet is eliminated, (there is no that case in the examples.)

(iii) Determination of Hole-Expansion Rate λ

The steel sheet was punched using a punching tool having a punch diameter of 10 mm and a die diameter of 10.9 mm (20% of clearance). Then, the punched hole was expanded by pressing-up a cylindrical flat bottom punch (50 mm in diameter and 8 mm in shoulder radius). The hole diameter d (mm) at the point of generating penetration crack at hole-edge was determined. Then, the hole-expansion rate λ (%) was calculated by the formula (3).

$$\lambda=100\times(d-10)/10 \quad (3)$$

Similar tests were repeated for total six times, and the average hole-expansion rate λ was determined.

Table 3 shows the result. Steel sheets Nos. 1 to 9, which are Examples of the present invention, gave 10% or smaller volume percentage of carbide having smaller than 0.5 μm of particle size, and, compared with Steel sheets Nos. 10 to 16, which are Comparative Examples with the same chemical compositions, respectively, the hole-expansion rate λ was large, and the stretch-flange formability was superior. A presumable cause of the superiority is that, as described above, although the fine carbide having smaller than 0.5 μm of particle size acts as the origin of voids during hole-expansion step, which generated voids connect with each other to induce fracture, the quantity of that fine carbide decreases to 10% or less by volume.

FIG. 1 shows the relation between the ΔHv (vertical axis) and the volume percentage of carbide having smaller than 0.5 μm of particle size, (horizontal axis), in cold-rolled and annealed sheets. As in the case of Steel sheets Nos. 1 to 8, which are Examples of the present invention, when the volume percentage of the carbide having smaller than 0.5 μm of particle size is brought to 10% or less, ΔHv becomes 10 or less, thereby providing excellent homogeneity of hardness in the sheet thickness direction, (black circle in FIG. 1). A presumable cause of the effect of fine carbide on the homogeneity of hardness is that the fine carbide likely segregates into a zone where pearlite existed.

Steel sheets Nos. 2, 4, 5, 7, and 9, which are Examples of the present invention, having 5% or less of volume percentage of carbide having smaller than 0.5 μm of particle size, prepared under the conditions of 600° C. or below of cooling-stop temperature and 550° C. or below of coiling temperature, provided not only more excellent stretch-flange formability but also more excellent homogeneity of hardness, of ΔHv of 7 or smaller, in sheet thickness direction.

According to the manufacturing method of the present invention, ΔHv of the hot-rolled sheet is small, 10 or less, thus the possibility of fracture during cold-rolling decreases in principle. Although not many conventional steel sheets actually suffer fracture, the widening of the adjustable range of cold-rolling condition without fear of fracture is highly advantageous in actual operations.

TABLE 1

| | Composition (mass %) | | | | | | | $A_{r3}$ transformation | $A_{c1}$ transformation |
|---|---|---|---|---|---|---|---|---|---|
| Steel | C | Si | Mn | P | S | Sol. Al | N | point* (° C.) | point** (° C.) |
| A | 0.24 | 0.19 | 0.82 | 0.009 | 0.0027 | 0.036 | 0.0030 | 794 | 737 |
| B | 0.36 | 0.21 | 0.76 | 0.012 | 0.0032 | 0.025 | 0.0042 | 775 | 735 |
| C | 0.52 | 0.22 | 0.73 | 0.010 | 0.0023 | 0.033 | 0.0035 | 752 | 730 |
| D | 0.65 | 0.20 | 0.74 | 0.014 | 0.0029 | 0.026 | 0.0028 | 733 | 725 |

*Calculated by the formula (1).

**Calculated by the formula (2).

TABLE 2

| Steel sheet No. | Steel | Hot-rolling conditions: Finishing temperature (° C.) | Cooling rate (° C./s) | Cooling-stop temperature (° C.) | Coiling temperature (° C.) | Annealing of hot-rolled sheet | Rolling reduction in cold-rolling (%) | Annealing (Cold-rolled sheet) | Remark |
|---|---|---|---|---|---|---|---|---|---|
| 1 | A | 809 | 115 | 610 | 530 | — | 55 | 710° C. × 40 hr | Example |
| 2 | A | 804 | 105 | 580 | 500 | 640° C. × 40 hr | 70 | 700° C. × 40 hr | Example |
| 3 | B | 795 | 75 | 640 | 590 | — | 65 | 680° C. × 40 hr | Example |
| 4 | B | 785 | 100 | 550 | 530 | 710° C. × 40 hr | 60 | 720° C. × 40 hr | Example |
| 5 | B | 790 | 95 | 570 | 540 | — | 55 | 710° C. × 40 hr | Example |
| 6 | C | 792 | 110 | 610 | 550 | 670° C. × 40 hr | 55 | 700° C. × 40 hr | Example |
| 7 | C | 767 | 85 | 570 | 530 | 710° C. × 40 hr | 50 | 720° C. × 40 hr | Example |
| 8 | D | 753 | 65 | 620 | 560 | 690° C. × 40 hr | 45 | 710° C. × 40 hr | Example |
| 9 | D | 763 | 95 | 550 | 480 | 720° C. × 40 hr | 50 | 720° C. × 40 hr | Example |
| 10 | A | 809 | 50 | 590 | 530 | 690° C. × 40 hr | 60 | 710° C. × 40 hr | Comparative example |
| 11 | A | 814 | 105 | 620 | 600 | — | 55 | 590° C. × 40 hr | Comparative example |
| 12 | B | 785 | 90 | 640 | 620 | — | 60 | 700° C. × 40 hr | Comparative example |
| 13 | B | 800 | 115 | 660 | 590 | 710° C. × 40 hr | 50 | 720° C. × 40 hr | Comparative example |
| 14 | C | 722 | 90 | 600 | 550 | 690° C. × 40 hr | 45 | 680° C. × 40 hr | Comparative example |
| 15 | C | 782 | 135 | 580 | 540 | 720° C. × 40 hr | 55 | 720° C. × 40 hr | Comparative example |
| 16 | D | 743 | 110 | 590 | 570 | 720° C. × 40 hr | 20 | 710° C. × 40 hr | Comparative example |

TABLE 3

| Steel sheet No. | Volume percentage of carbide having smaller than 0.5 μm of particle size (%) | ΔHv (Hot-rolled sheet) | ΔHv (Cold-rolled steel sheet) | λ (%) | Remark |
|---|---|---|---|---|---|
| 1 | 8 | 10 | 9 | 154 | Example |
| 2 | 4 | 9 | 6 | 185 | Example |
| 3 | 7 | 10 | 10 | 89 | Example |
| 4 | 3 | 8 | 6 | 113 | Example |
| 5 | 5 | 8 | 7 | 95 | Example |
| 6 | 8 | 10 | 10 | 67 | Example |
| 7 | 5 | 10 | 7 | 83 | Example |
| 8 | 7 | 9 | 8 | 50 | Example |
| 9 | 5 | 8 | 5 | 58 | Example |
| 10 | 20 | 17 | 16 | 81 | Comparative Example |
| 11 | 22 | 17 | 17 | 73 | Comparative Example |
| 12 | 18 | 17 | 16 | 41 | Comparative Example |
| 13 | 13 | 13 | 12 | 58 | Comparative Example |
| 14 | 16 | 18 | 17 | 38 | Comparative Example |
| 15 | 19 | 21 | 19 | 41 | Comparative Example |
| 16 | 19 | 19 | 18 | 20 | Comparative Example |

Example 2

Continuous casting was applied to the steels given below to form the respective slabs:

Steel E (0.30% C, 0.23% Si, 0.77% Mn, 0.013% P, 0.0039% S, 0.028% Sol.Al, 0.0045% N, by mass; 786° C. of Ar3 transformation point; and 737° C. of $A_{c1}$ transformation point);

Steel F (0.23% C, 0.18% Si, 0.76% Mn, 0.016% P, 0.0040% S, 0.025% Sol.Al, 0.0028% N, 1.2% Cr, by mass; 785° C. of $A_{r3}$ transformation point; and 759° C. of $A_{c1}$ transformation point);

Steel G (0.33% C, 0.21% Si, 0.71% Mn, 0.010% P, 0.0042% S, 0.033% Sol.Al, 0.0035% N, 1.02% Cr, 0.16% Mo, by mass; 775° C. of $A_{r3}$ transformation point; and 755° C. of $A_{c1}$ transformation point);

Steel H (0.36% C, 0.20% Si, 0.70% Mn, 0.013% P, 0.009% S, 0.031% Sol.Al, 0.0031% N, by mass; 776° C. of $A_{r3}$ transformation point; and 735° C. of $A_{c1}$ transformation point); and Steel D given in Table 1.

These slabs were heated to 1210° C., which were then treated by hot-rolling under the respective conditions shown in Table 4, while, in some examples, giving annealing of hot-rolled sheet under the conditions given in the table. After that, cold-rolling was given to these sheets, and further annealing was given under the respective conditions given in Table 4 to prepare Steel sheets Nos. 17 to 35, having 2.3 mm of thickness. The rolling reduction in the cold-rolling was 50%, and the annealing of hot-rolled sheet and the annealing were given in a non-nitrizing atmosphere ($H_2$ atmosphere).

To thus prepared cold-rolled steel sheets and hot-rolled sheets (only for determining hardness), similar method to that in Example 1 was applied to determine the particle size and volume percentage of carbide, the hardness in the sheet thickness direction, and the hole-expansion rate λ. The results are given in Table 5.

Among Steel sheets Nos. 17 to 23 in which the conditions other than the cooling rate were kept constant, Steel sheets Nos. 18 to 22 in which the cooling rate was within the range of the present invention showed significantly excellent stretch-flange formability and homogeneity of hardness in the sheet thickness direction. Steel sheets Nos. 19 to 22 showed further significant improvement in these characteristics, giving maximum values thereof at around 100° C./s (for Steel sheets Nos. 20 to 22).

As for Steel sheets Nos. 24 to 31 which were treated by a constant cooling rate, Steel sheets Nos. 26 to 31 which are within the range of the present invention in both the cooling-stop temperature and the coiling temperature gave significantly excellent values in the stretch-flange formability and the homogeneity of hardness in the sheet thickness direction. For the case of satisfying 600° C. or lower cooling-stop temperature and of 550° C. or lower coiling temperature, (Steel sheets Nos. 29 to 31), the volume percentage of fine carbide became 5% or less, thus further significantly excellent stretch-flange formability and homogeneity of hardness in the sheet thickness direction were attained. Compared with Steel sheet No. 30 which adopted the temperature of annealing of hot-rolled sheet of 690° C. or below, Steel sheet No. 21 which was treated under the same condition except for the temperature of annealing of hot-rolled sheet of 690° C. or below gave further superior stretch-flange formability. Compared with Steel sheet No. 31 which eliminated the annealing of hot-rolled sheet, Steel sheet No. 21 which was treated by the same condition except for applying the annealing of hot-rolled sheet improved the homogeneity.

Also for the cases of adding alloying elements other than the basic components, (Steel F and Steel G), there attained excellent stretch-flange formability and homogeneity of hardness in the sheet thickness direction without raising problems. Compared with the case of large amount of S, (Steel H), Steel E, Steel F, and Steel G gave further significantly excellent absolute values of hole-expansion rate.

TABLE 4

| Steel sheet No. | Steel | Hot-rolling conditions: Finishing temperature (° C.) | Cooling rate (° C./s) | Cooling-stop temperature (° C.) | Coiling temperature (° C.) | Annealing of hot-rolled sheet | Annealing (Cold-rolled sheet) |
|---|---|---|---|---|---|---|---|
| 17 | E | 820 | 50 | 560 | 530 | 700° C. × 30 hr | 715° C. × 40 hr |
| 18 | E | 820 | 70 | 560 | 530 | 700° C. × 30 hr | 715° C. × 40 hr |
| 19 | E | 820 | 85 | 560 | 530 | 700° C. × 30 hr | 715° C. × 40 hr |
| 20 | E | 820 | 95 | 560 | 530 | 700° C. × 30 hr | 715° C. × 40 hr |
| 21 | E | 820 | 105 | 560 | 530 | 700° C. × 30 hr | 715° C. × 40 hr |
| 22 | E | 820 | 115 | 560 | 530 | 700° C. × 30 hr | 715° C. × 40 hr |
| 23 | E | 820 | 140 | 560 | 530 | 700° C. × 30 hr | 715° C. × 40 hr |
| 24 | E | 820 | 105 | 660 | 530 | 700° C. × 30 hr | 715° C. × 40 hr |
| 25 | E | 820 | 105 | 630 | 610 | 700° C. × 30 hr | 715° C. × 40 hr |
| 26 | E | 820 | 105 | 630 | 560 | 700° C. × 30 hr | 715° C. × 40 hr |
| 27 | E | 820 | 105 | 630 | 530 | 700° C. × 30 hr | 715° C. × 40 hr |
| 28 | E | 820 | 105 | 580 | 560 | 700° C. × 30 hr | 715° C. × 40 hr |
| 29 | E | 820 | 105 | 580 | 530 | 700° C. × 30 hr | 715° C. × 40 hr |
| 30 | E | 820 | 105 | 560 | 530 | 680° C. × 30 hr | 715° C. × 40 hr |
| 31 | E | 820 | 105 | 560 | 530 | — | 715° C. × 40 hr |
| 32 | D | 810 | 105 | 560 | 530 | 720° C. × 40 hr | 690° C. × 30 hr |
| 33 | F | 815 | 105 | 560 | 530 | 710° C. × 60 hr | 700° C. × 50 hr |
| 34 | G | 815 | 105 | 560 | 530 | 700° C. × 30 hr | 715° C. × 40 hr |
| 35 | H | 815 | 105 | 560 | 530 | 700° C. × 30 hr | 715° C. × 40 hr |

TABLE 5

| Steel sheet No. | Volume percentage of carbide having smaller than 0.5 μm of particle size (%) | ΔHv (Hot-rolled sheet) | ΔHv (Cold-rolled steel sheet) | λ (%) |
|---|---|---|---|---|
| 17 | 19 | 18 | 16 | 39 |
| 18 | 8 | 12 | 10 | 85 |
| 19 | 5 | 9 | 7 | 101 |
| 20 | 5 | 9 | 7 | 105 |
| 21 | 3 | 7 | 4 | 123 |
| 22 | 4 | 8 | 6 | 110 |
| 23 | 21 | 20 | 18 | 42 |
| 24 | 18 | 16 | 14 | 44 |
| 25 | 19 | 15 | 13 | 51 |
| 26 | 8 | 10 | 8 | 92 |
| 27 | 7 | 9 | 8 | 89 |
| 28 | 8 | 10 | 8 | 86 |
| 29 | 5 | 8 | 7 | 106 |
| 30 | 5 | 8 | 7 | 95 |
| 31 | 5 | 9 | 6 | 88 |
| 32 | 5 | 8 | 6 | 62 |
| 33 | 5 | 8 | 7 | 120 |
| 34 | 5 | 9 | 7 | 104 |
| 35 | 5 | 8 | 7 | 65 |

INDUSTRIAL APPLICABILITY

The present invention has realized the manufacture of high carbon cold-rolled steel sheet which gives excellent stretch-flange formability and excellent homogeneity of hardness in the sheet thickness direction while decreasing the load to the cold-rolling, without adding special apparatus.

The invention claimed is:

1. A method for manufacturing a high carbon cold-rolled steel sheet, comprising the steps of:

hot-rolling a steel containing 0.2 to 0.7% C by mass at a finishing temperature of ($A_{r3}$ transformation point −20° C.) or above to prepare a hot-rolled sheet;

cooling the hot-rolled sheet to a temperature of 650° C. or below at a cooling rate ranging from 60° C./s to 115° C./s;

coiling the hot-rolled sheet after cooling at a coiling temperature of 600° C. or below;

cold-rolling the coiled hot-rolled sheet at a rolling reduction of 30% or more to prepare a cold-rolled sheet; and annealing the cold-rolled sheet at an annealing temperature ranging from 600° C. or larger to $A_{c1}$ transformation point or lower such that the sheet has a homogeneity of hardness represented by a difference between maximum hardness $H_{v\ max}$ and minimum hardness $H_{v\ min}$, $\Delta H=(H_{v\ max}-H_{v\ min})$, in a sheet thickness direction of 10 or less.

2. The method for manufacturing a high carbon cold-rolled steel sheet according to claim 1, wherein the step of cooling is carried out by cooling the hot-rolled sheet to a temperature of 600° C. or below at a cooling rate ranging from 80° C./s or larger to smaller than 115° C./s, and the step of coiling conducts coiling the sheet at a temperature of 550° C. or below.

3. The method for manufacturing a high carbon cold-rolled steel sheet according to claim 1, wherein the hot-rolled sheet after coiling is annealed at an annealing temperature ranging from 600° C. or larger to $A_{c1}$ transformation point or lower, followed by applying the cold-rolling.

4. The method for manufacturing a high carbon cold-rolled steel sheet according to claim 2, wherein the hot-rolled sheet after coiling is annealed at an annealing temperature ranging from 600° C. or larger to $A_{c1}$ transformation point or lower, followed by applying the cold-rolling.

5. The method for manufacturing a high carbon cold-rolled steel sheet according to claim 1, wherein steel contains a volume percentage of carbide having a particle size smaller than 0.5 μm of 10% or less.

6. The method for manufacturing a high carbon cold-rolled steel sheet according to claim 2, wherein the steel contains a volume percentage of carbide having a particle size smaller than 0.5 μm of 5% or less.

* * * * *